US009386806B2

(12) United States Patent
Bailey et al.

(10) Patent No.: US 9,386,806 B2
(45) Date of Patent: Jul. 12, 2016

(54) MULTI-FUNCTIONAL BIB AND APRON

(76) Inventors: Teresa Bailey, Accokeek, MD (US); Erin C. Bailey, Accokeek, MD (US); Ebony C. Bailey, Accokeek, MD (US)

( * ) Notice: Subject to any disclaimer, the term of this patent is extended or adjusted under 35 U.S.C. 154(b) by 386 days.

(21) Appl. No.: 13/360,759

(22) Filed: Jan. 29, 2012

(65) Prior Publication Data

US 2012/0174279 A1 Jul. 12, 2012

Related U.S. Application Data

(63) Continuation-in-part of application No. 13/212,161, filed on Aug. 17, 2011, now abandoned.

(60) Provisional application No. 61/374,317, filed on Aug. 17, 2010.

(51) Int. Cl.
*A41B 13/10* (2006.01)

(52) U.S. Cl.
CPC ..... *A41B 13/10* (2013.01); *A41B 13/103* (2013.01)

(58) Field of Classification Search
CPC ... A41D 13/04; A41D 1/205; A41D 13/0012; A41D 13/1209; A41D 2400/52; A41D 2400/72; A41D 27/10; A41D 27/12; A41D 27/20; A41D 31/0061; A41D 13/043; A41D 13/046; A41D 13/0518; A41D 13/1184; A41D 15/00; A41D 11/00; A41D 13/118; A41B 13/10; A41B 13/103
USPC ..... 2/48, 49.1, 49.2, 49.4, 49.3, 46, 50, 51, 2/49.5, 239
See application file for complete search history.

(56) References Cited

U.S. PATENT DOCUMENTS

| | | | | | |
|---|---|---|---|---|---|
| 1,970,307 | A | * | 8/1934 | Hartmann | 2/48 |
| 2,129,486 | A | * | 9/1938 | Berman | 2/51 |
| 2,911,649 | A | * | 11/1959 | Ruelle et al. | 2/69.5 |
| 4,397,378 | A | * | 8/1983 | Lee | 190/119 |
| 4,441,212 | A | | 4/1984 | Ahr et al. | |
| 4,495,658 | A | | 1/1985 | Moret et al. | |
| 4,569,086 | A | * | 2/1986 | Takefman | 2/49.2 |
| D288,022 | S | * | 2/1987 | Marconi | D2/862 |
| 4,649,572 | A | | 3/1987 | Roessler | |
| 4,660,224 | A | * | 4/1987 | Ashcraft | 2/48 |
| 5,107,545 | A | * | 4/1992 | Potter | 2/46 |
| 5,220,692 | A | * | 6/1993 | Cox | 2/48 |
| 5,566,391 | A | * | 10/1996 | Williamson | 2/51 |
| 5,960,471 | A | * | 10/1999 | Burton | 2/48 |
| 5,960,472 | A | * | 10/1999 | Reid | 2/48 |

(Continued)

*Primary Examiner* — Alissa L Hoey
*Assistant Examiner* — Catherine M Ferreira
(74) *Attorney, Agent, or Firm* — Patent Analysis Research Tech Systems LLC; George L. Walton

(57) ABSTRACT

The invention provides a bib and apron apparatus having a first member defining a bib sized to be fitted around a user's neck and a second member defining an apron sized to cover the user's body between the stomach and legs. A pocket is located on the bib for housing snacks or other items essential to the user. The first member includes an attachment mechanism that connects to an attachment mechanism on the second member such that the connected first and second members covers nearly the full body of the user to prevent staining any portion of the user's clothing or for hygienic purposes. An apron having safety pockets for storing apron securing straps therein when the bib is attached thereto. The apron and bib further includes at least one safety flap for selectively covering and protecting the attachment mechanisms and/or a user's body.

20 Claims, 7 Drawing Sheets

(56) References Cited

U.S. PATENT DOCUMENTS

| | | | | |
|---|---|---|---|---|
| D416,663 | S * | 11/1999 | Thomas | D2/861 |
| 6,141,798 | A * | 11/2000 | Manning | 2/49.1 |
| D447,999 | S * | 9/2001 | Thomson | D12/416 |
| 6,644,317 | B1 | 11/2003 | Lawton | |
| 6,708,341 | B1 * | 3/2004 | Schaller | 2/51 |
| D499,530 | S * | 12/2004 | Mintz et al. | D2/864 |
| 7,032,248 | B1 * | 4/2006 | Gutilla | 2/49.1 |
| 7,788,734 | B2 | 9/2010 | Menoudakos | |
| D686,393 | S * | 7/2013 | Sewall | D2/864 |
| 8,707,467 | B2 * | 4/2014 | Sohn | 2/104 |
| 2005/0102729 | A1 * | 5/2005 | Snedeker | 2/96 |
| 2008/0276431 | A1 * | 11/2008 | DelPrete et al. | 24/3.13 |
| 2009/0151040 | A1 * | 6/2009 | Lee-Johnson et al. | 2/51 |
| 2011/0010816 | A1 | 1/2011 | Johnson | |
| 2011/0154552 | A1 * | 6/2011 | Fletcher | 2/48 |
| 2011/0296577 | A1 * | 12/2011 | Jackson, Jr. | 2/48 |

* cited by examiner

MULTI-FUNCTIONAL BIB AND APRON

CROSS REFERENCE TO RELATED APPLICATION(S)

This instant application is a Continuation-In-Part Application that claims priority to U.S. Non-Provisional patent application Ser. No. 13/212,161, filed on Aug. 17, 2011, which claims the benefit of U.S. Provisional Patent Application Ser. No. 61/374,317, filed on Aug. 17, 2010.

BACKGROUND OF THE INVENTION

1. Field of the Invention

The present invention relates to a bib and apron and more specifically to a multi-functional bib and apron apparatus having a bib and an apron that attach to cover nearly the full body of the user.

2. Description of the Related Art

Bibs are used to prevent staining of the user's clothing. Bibs collect articles such as food, drool, liquids and other things that escape users' mouths. Also, some users use bibs as napkins and wipe their hands thereon. Traditional bibs are uncomfortable and are often too small in relation to users. Their small sizes only allow the bibs to collect only small amounts of articles and the portion of users' clothing not covered by the bibs are often left permanently stained.

Background prior art patents disclose bibs with pockets and bibs and full length or detachable apron combinations with pockets which take on many different designs and structures are disclosed and described in U.S. Pat. Nos. 4,441,212 4,495,658, 4,649,572, 5,960,471, 6,266,820, 6,644,317, 7,788,734 and U.S. Publication No. 2011/0010816 to name just a few of interest. However, they do not singly or in any combination teach the claimed invention.

SUMMARY OF THE INVENTION

The present invention discloses a bib and apron that provides a connected bib and apron which covers nearly the full body of a user to prevent staining any portion of the user's clothing or for hygienic purposes.

An aspect of an embodiment of the present invention provides a pocket having an opening being positioned at least proximate the center of the bib which may house snacks or other items essential to the user.

A further aspect of an embodiment of the present invention provides an attachment mechanism on the bib to a mating attachment mechanism on the apron that secures the bib to the apron.

A further aspect of an embodiment of the present invention provides a bottom portion of the apron sized to rest on and about the user's legs.

A further aspect of an embodiment of the present invention provides the user the option to wear the bib alone or attached to the apron and vice versa where the apron is worn alone or attached to the bib.

A further aspect of an embodiment of the present invention provides a safety flap cover member adjacent the top portion of the apron for protecting or covering the attachment mechanism on the apron that secures the apron to the bib A further aspect of an embodiment of the present invention provides a safety flap cover member adjacent the bottom portion of the bib for protecting or covering the attachment mechanism on the bib that secures the bib to the apron.

A further aspect of an embodiment of the present invention provides a strap safety storage compartment having a pair of pull-apart sections defining a pocket member at each peripheral or seam corner adjacent the top portion of the apron for storing apron straps therein when the bib is attached thereto. Each pocket member includes a fastening member disposed at least at an upper location on an interior portion of each of the pull-apart sections for releasably engaging one another for closing the pocket members when the apron straps are stored therein or after the apron straps have been removed there from. The fastening members allow the pull-apart sections to be easily and quickly separated from one another.

A further aspect of an embodiment of the present invention provides a stretchable waist strap member secured at one peripheral edge of the apron, with the other end of the waist strap member having a fastening member thereon and being releasably attached to a fastening member disposed on either a front or back surface of the apron at the other peripheral edge thereof.

Another aspect of an embodiment of the present invention provides mating attachment means along an opposite interior surfaces of the bib pocket opening at top edges thereof for securing the pocket opening in a closed position.

An additional aspect of an embodiment of the present invention provides a loop member secured at a desired location along a border or peripheral edge of the bib for attaching an item such as a pacifier thereto.

Another aspect of an embodiment of the present invention provides a stretchable member secured at a desired location along a border or peripheral edge of the bib for attaching items such as pacifiers, toys, or other user items thereto.

Additional aspects, objectives, features and advantages of the present invention will become better understood with regard to the following description and the appended claims of the preferred embodiments with reference to the accompanying drawings.

BRIEF DESCRIPTION OF THE DRAWINGS

The present invention may be better understood, along with its numerous objects, features, and advantages made apparent to those skilled in the art by referencing the accompanying drawings.

DETAILED DESCRIPTION

Figure 1:
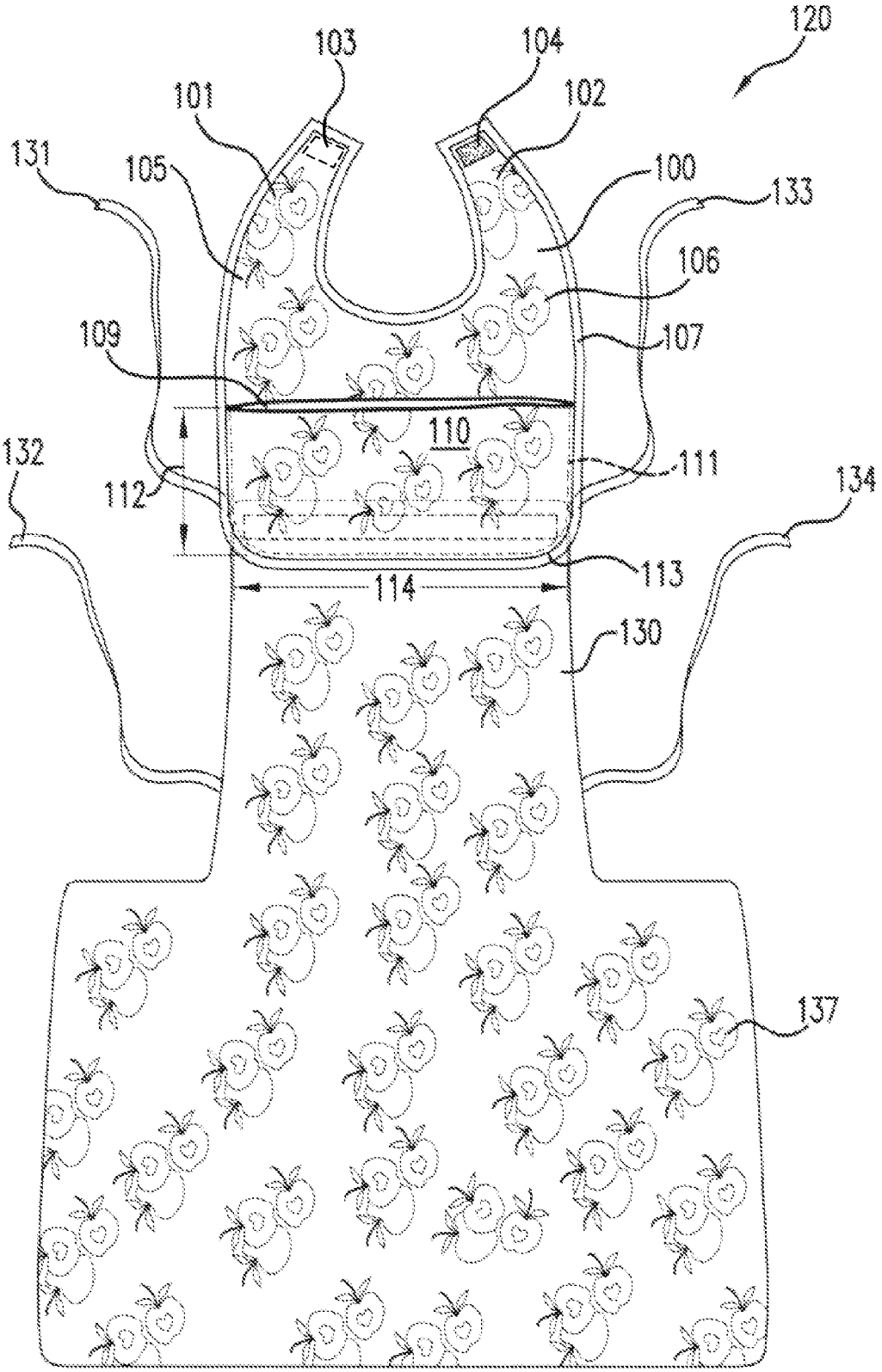
FIG. 1 illustrates a perspective view of the bib connected to the apron according to the present invention.

FIG. 1 is a perspective view of the bib 100 connected to the apron 130. The bib and apparatus 120 is a multi-functional and waterproof bib, snack sack pocket and lap cover for messy eating, or for hygienic purposes, for example. The apparatus 120 can also serve as an apron if the child wants to help in the kitchen and/or play house. Additional trinkets or necessities may be attached to the bib such as a pacifier holder (See FIGS. 10 and 11). The apparatus 120 features a first material in the form of a bib sized to be fitted around a user's neck and a second material in the form of an apron sized to cover the user's body between the stomach and legs.

The bib 100 is made from a lightweight waterproof material such as neoprene or any polyester material. The bib 100 is worn hanging from the neck of a user and down to the user's chest to protect the user's clothing from spillage thereon. Various materials may be used to manufacture the bib 100 provided they are not harmful to the user. Also, the bib 100 features a top or front layer 105 that may have a bib design 106 pleasing to the user. Note that the design 106 shown in FIG. 1 is for illustration purposes only, whereas the design 106 may be any type of image on the bib 100 having any style size, shape or color. The bib 100 also features a border 107 on the outer perimeter. Also, the border 107 can be a solid or multi-color design to complement the design 106 on the bib 100.

Figure 2:
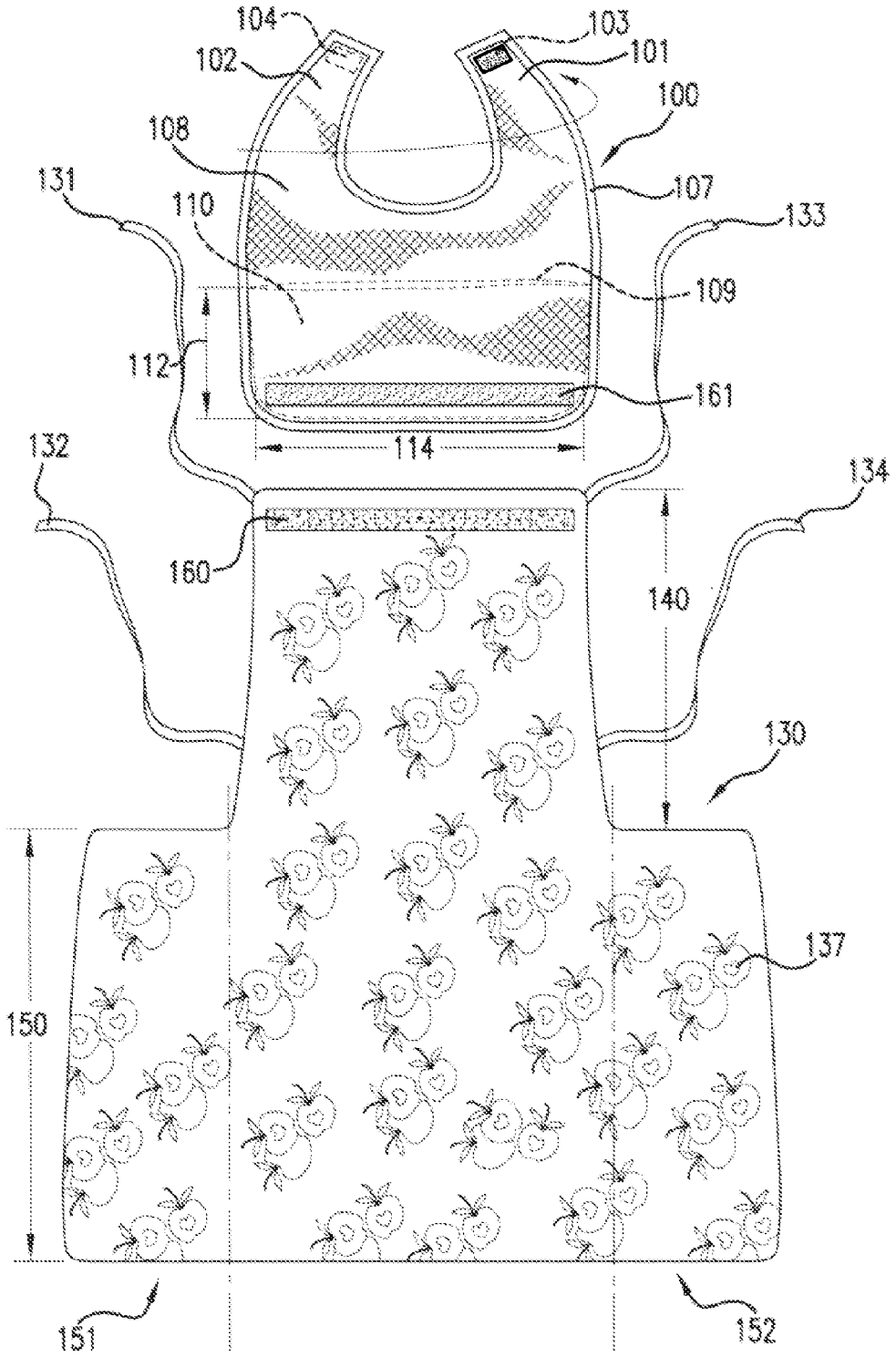
FIG. 2 illustrates a view of the back of the bib and the front of the apron according to the present invention.

As shown in FIG. 2, a back or rear layer material 108 of the bib 100 is on the back or rear side thereof. A lining (not shown) may be provided between the top layer 105 and the bottom layer 108 to add additional support and stiffness of the bib 100, if desired. An access opening or slit 109 is provided substantially near the center of the bib 100. Additionally, the access opening or slit 109 can be positioned higher or lower than the center, if it is desired, to increase the depth 112 of the pocket 110 formed. The depth or width 112 of the pocket 110 is defined as the length between the access opening or slit 109 and the bottom 113 of the bib 100. The pocket 110 has a length that is substantially equal to the length 114 of the bib 100. The pocket 110 length and width may vary depending on the snacks or other items essentials to the user. For example, the pocket 110 for a child may hold items, such as, snacks and toys. Also, the pocket 110 for an elderly person may house items, such as, medicine, keys, etc. In addition, the pocket 110 may be closed by using known closure mechanisms selected from the group consisting of zippers, buttons, or hook and loop type fasteners, such as Velcro. The bib 100 further features arms 101 and 102. The arms 101 and 102 may be positioned around the user's neck to secure the bib 100 thereabout. The arms include a female and male mating mechanisms 103 and 104 that may be selected from the group consisting of hook and loop type fasteners, such as, Velcro, buttons or other known connectors or fasteners that will connect the arms 101 and 102 together.

Apron 130 is shown attached to the bib 100. The apron 130 is an outer protective garment that covers primarily the front of the user's body. Note that the apron 130 may be manufactured from the same materials as the bib 100. Also, the apron includes straps 131, 132, 133, and 134. The straps 131 and 133 may be tied or connected to one another such they form a loop to be placed around the user's neck, along with the arms 101 and 102 of the bib 100. Straps 133 and 134 are tied or connected together such that they extend around the user's waist and back to secure the apron 130 to the user. Alternatively, straps 131 and 132 may be connected to one another and straps 133 and 134 may be connected to one another in such a manner to form loops to allow the user's arms to be extended through the loops to secure the apron to the user body, while the arms 101 and 102 are secured about the user's neck, thereby securing the bib 100 and apron 130 as a unit, primarily about the user's front body. In addition, the apron 130 also includes an apron design 137 thereon that is identical or complements the bib design 106.

Figure 4:
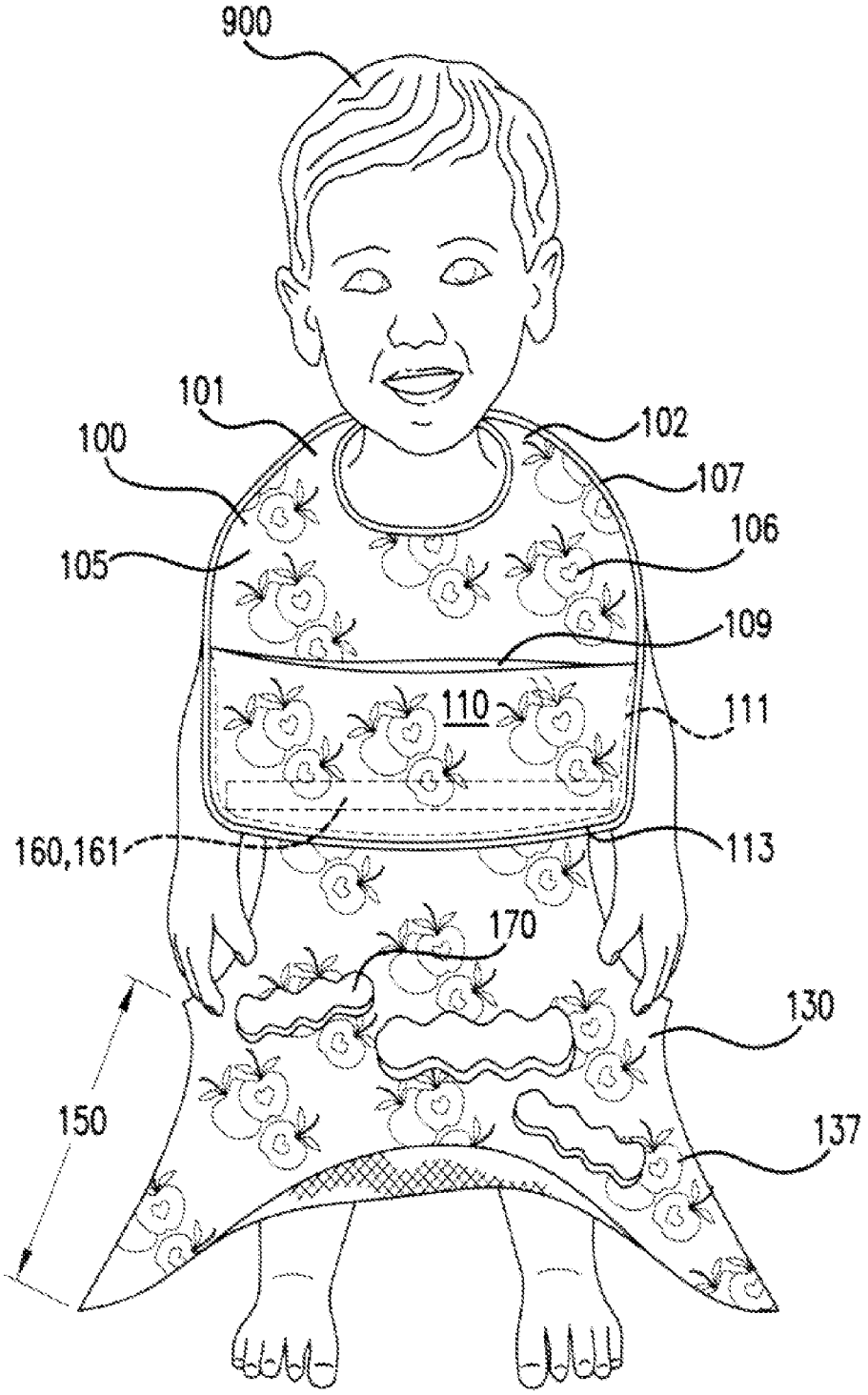
FIG. 4 illustrates a perspective view of the bib and apron connected and positioned on a user according to the present invention.
Figure 5:
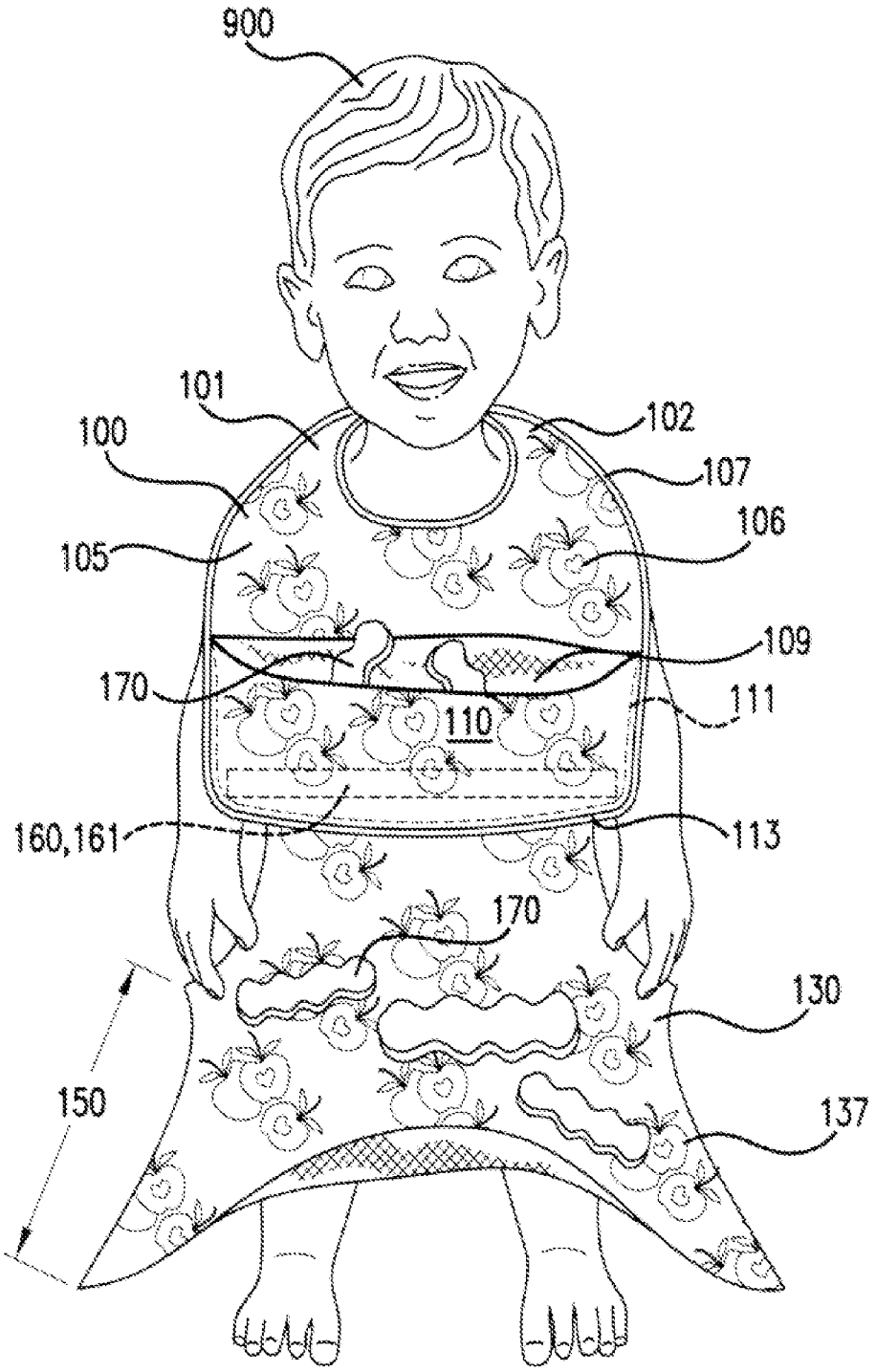
FIG. 5 illustrates a perspective view of the bib and apron connected and positioned on a user with articles shown in a pocket of the bib according to the present invention.

FIG. 2 is a view of the back or rear of the bib 100 and the front of the apron 130. The apron 130 is an inverted T-shaped design such that the top section 140 extends to a length and width that at least cover the user's stomach and knees. A bottom section 150 is longer and wider than the top section 140 and extends from about the knees of the user to the ankles. The bottom section 150 includes wings 151 and 152 that rest freely on the user's legs such that they extend over and cover a side portion the user's legs as shown in FIGS. 4 and 5. The top section 140 further includes an apron hook and loop type attachment mechanism 160 shown as a strip of Velcro. Additional apron attachment mechanisms may be used, such as buttons, zippers or snaps, not shown, if desired. The hook and loop type attachment mechanism 160 should extend so that the hook and loop type attachment 160 aligns and mates with a hook and loop type attachment mechanism 161 shown as a strip of Velcro. As shown in FIG. 2, the hook and loop type fastener 160 of the apron 130 and the hook and loop type fastener 161 of the bib 100 are shown to be equal in length to mate with each other to secure the bib 100 and the apron 130 together as a unit. Once attached, the bib 100 is secured to the apron 130 providing full coverage of the user's clothing to prevent staining from messy eating or the wasting of food and drinks thereon or for hygienic purposes.

Figure 3:
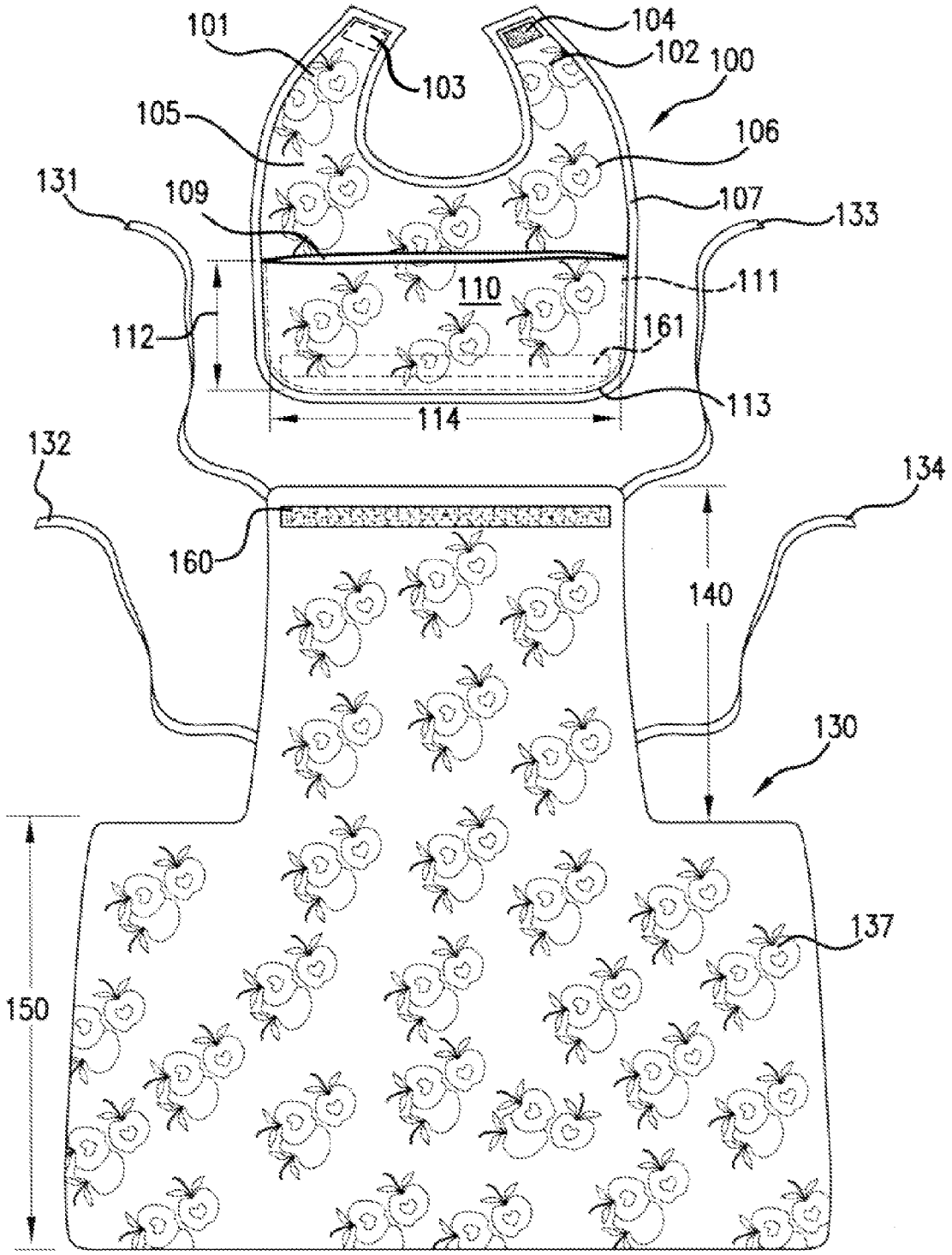
FIG. 3 illustrates a front view of the bib and the apron according to the present invention.

FIG. 3 shows a front view of bib 100 and apron 130 that is separated from one another. The apron 130 also includes the pocket 110 extending along the front of the apron 130 with ends thereof being contiguous to the border 107 to house essential user items therein.

FIG. 4 shows a perspective view of the bib 100 and apron 130 connected together as a single unit and positioned about a user.

FIG. 5 illustrates a perspective view of the bib 100 and apron 130 connected and positioned on a user with articles 170 shown in the pocket 110 of the bib 100. The user 900, shown for illustration purposes represents a child. However, the user may be anyone who desires his clothing or body to be covered so that stains are prevented from messy eating or the wasting of food and drinks thereon or for hygienic purposes. The surface of the bottom section 150 may be used to support the articles 170. Alternatively, the articles 170 may be housed in the pocket 110.

In FIGS. 6-11 the same reference elements as shown in FIGS. 1-5 will further include a character element a and a character element a' to distinguish them from one another.

Figure 6:
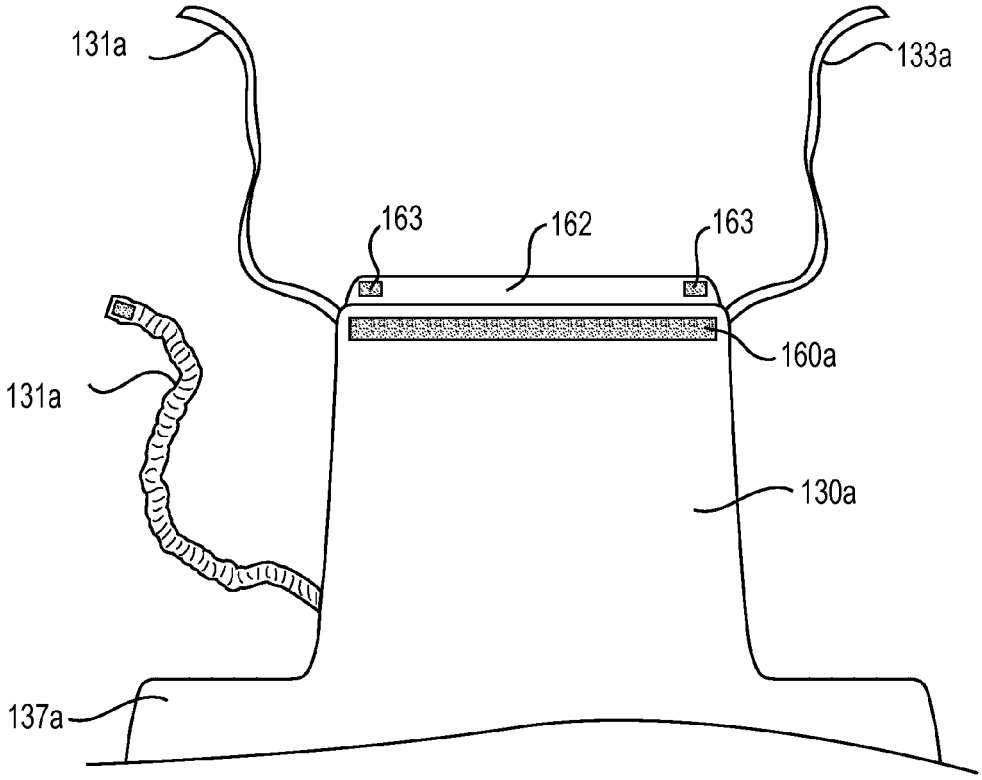
FIG. 6 illustrates a front cut-sectional view of the apron with a safety flap cover member at a top portion of the apron and a stretchable waist strap member having one end secured to one peripheral edge of the apron and the other end of the waist strap having attachment or fastening means for releasably attaching to the other peripheral edge of the apron according to the present invention.

FIG. 6 depicts a front cut-sectional view of the apron with an upper elongated smaller dimensional body area section 130*a* and a partial lower elongated greater dimensional body area section 137*a*. The upper section 130*a* at a top portion includes a hook and loop fastener 160*a*, such as a Velcro strip, which is similar to the hook and loop fastener 160 as shown in FIGS. 1-5. The top portion of the apron section 130*a* includes a safety flap cover member 162*a* extending upward from the top portion of the apron section 130*a*. Further, the safety flap cover member 162 extends at least across a portion of a length of the top portion having at least a hook and loop fastener 163 at each peripheral end of the safety flap cover member 162. The safety flap cover member 162 will be folded and flipped over the hook and loop fastener 160*a* and matingly engage the at least a hook and loop fastener 163 to cover and protect the hook and loop fastener 160*a* of the apron section 130*a* from any damage when the bib 100*a* (See FIGS. 9-11) is not being used. Note that the at least a hook and loop fastener 163 could extend across at least a portion of the undersurface of the safety flap cover member 162 to fully engage the entire hook and loop fastener 160*a* of the apron section 130*a*, if desired. When the bib 100*a* is to be used the safety flap cover member 162 is easily unfolded and flipped upward and positioned above the apron section 130*a* top portion or over the apron section 130*a* top portion to the back side 130*a*' of the apron section 130*a* to expose the hook and loop fastener 160*a* of the apron section 130*a*, so that the bib hook and loop fastener 161 (See FIG. 9) can be secured to the hook and loop fastener 160*a* of the apron section 130*a*.

Also, straps 131*a* and 133*a* are secured to the top portion of the apron section 130*a* adjacent upper peripheral edges and function in the same manner as previously discussed for FIGS. 1-5. Rather than using straps 132 and 134 as shown and previously discussed for FIGS. 1-5, a stretchable waist strap 164 is substituted therefore with one end being secured at a peripheral edge at a corner seam location on the smaller elongated dimensional body area section 130*a* of the inverted T-shaped design of apron 130. The other end of the stretchable waist strap 164 has a hook and loop fastener 165, such as Velcro, attached thereto.

Figure 7:
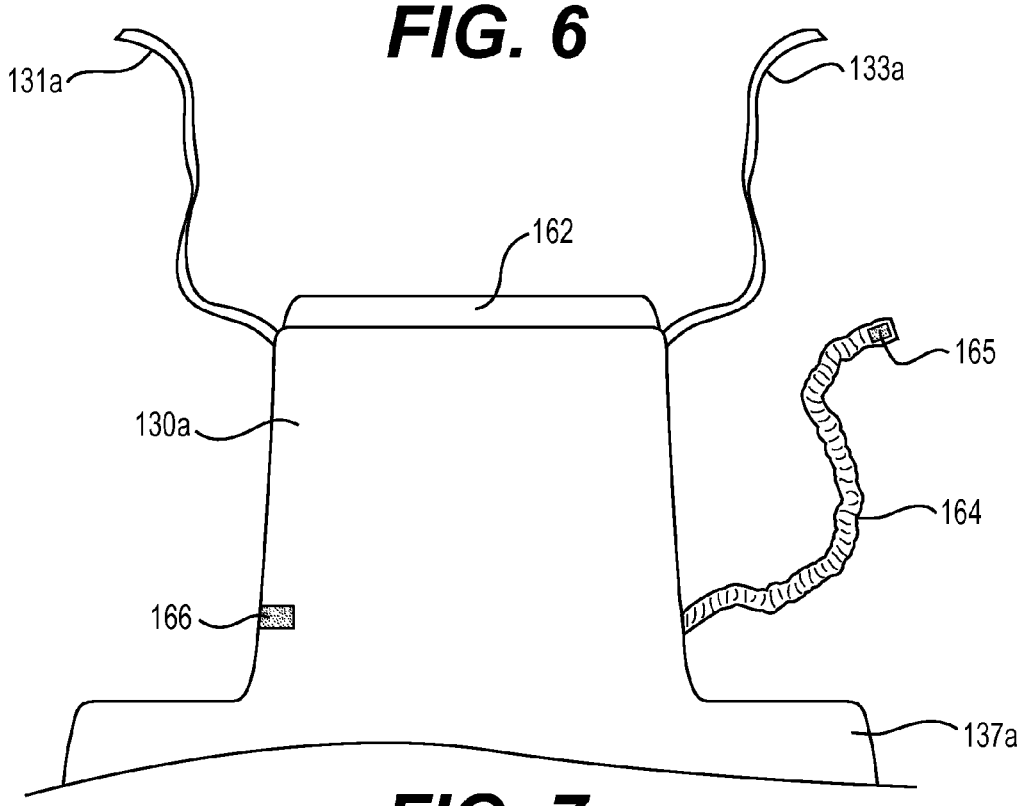
FIG. 7 illustrates a back or rear cut-sectional view of the apron with a safety flap cover member at a top portion of the apron and a stretchable waist strap member having one end secured to one peripheral edge of the apron and the other end of the waist strap having attachment or fastening means thereon for releasably attaching to a mating attachment or fastening means on a back surface of the apron at a location at the other end of the apron according to the present invention.

FIG. 7 shows a back cut-sectional view of the apron sections 130*a* and 137*a* with the same elements as the front cut-sectional view of the apron sections 130*a* and 137*a* discussed in FIG. 6 above. Note that in FIG. 7 the safety flap cover member 162 is shown in an extended position that will allow it to be flipped up to an extended position or flipped and folded from the top portion of the apron section 130*a* to the back side of apron 130*a*, which exposes the hook and loop fastener 160*a* for easily attaching the hook and loop fastener 161*a* of the bib thereto, if desired. Opposite the secured area that the stretchable waist strap 164 one end is attached as discussed in FIG. 6 above, a hook and loop fastener 166 is disposed on a back surface of the smaller elongated dimension of the inverted T-shaped design of apron section 130*a* adjacent the other peripheral side edge of the apron section 130*a* for attaching the hook and loop fastener 165 to the hook and loop fastener 166 about the waist of a user.

Figure 8:
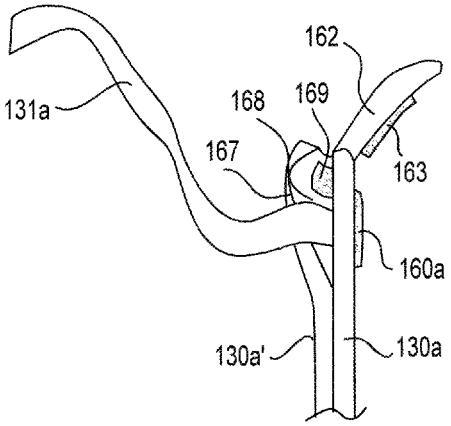
FIG. 8 illustrates an exploded side cut-sectional view of the apron with a safety pocket member at a top edge portion of the apron for storing straps that are secured at a top portion of the apron therein with attachment means for closing pocket member when the bib is attached thereto according to the present invention.

In reference to the exploded side cut-sectional view of FIG. 8, only one side thereof is shown. A separate safety pocket device including a back pull-apart wall portion 167 at an upper peripheral edge of the apron back side surface 130*a*' and a front pull-apart wall portion behind the hook and loop fastener 160*a* at an upper peripheral edge of the front side surface on the upper elongated smaller body dimensional body area of apron section 130*a* along the peripheral edge at the corner seam of the upper smaller dimensional body area of apron section 130*a*. The pull-apart wall portions are disposed below the safety flap cover member 162 and behind the hook and loop fastener 160*a* and defining a pocket opening 168 disposed at the upper peripheral edges of both sides of the upper smaller elongated dimensional body area of the inverted T-shaped design of apron section 130*a*. This pocket opening 168 provides a storage space for storing the straps 131*a* and 133*a* (See FIGS. 6-8) therein when the bib 100*a* (See FIG. 9) is to be attached thereto.

Also, FIG. 8 shows the safety flap cover member 162 in a flipped up position that releases the hook and loop fastener 163 of the safety flap cover member 162 from the hook and loop fastener 160*a* at the top portion of the upper smaller elongated dimensional body area of the inverted T-shaped design of apron section 130*a*. In addition, an interior surface of the back pull-apart wall portion 167 with the pocket opening 168 includes a hook and loop fastener 169 disposed on an interior surface of the back pull-apart wall portion 167 within the pocket opening 168. The hook and loop fastener 169 mates with a similar hook and loop fastener (not shown) at a back side of the upper peripheral edge of the apron front side surface of apron section 130*a* behind the hook and loop fastener 160*a* for opening and closing the pocket opening 168.

Figure 10:
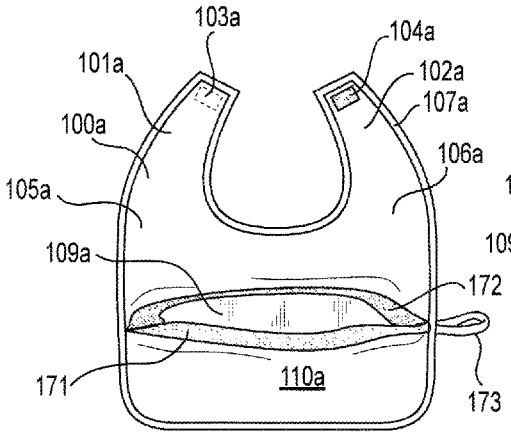
FIG. 10 illustrates a front view of the bib with mating attachment means along opposite interior surfaces of a bib pocket access opening at top edges thereof for releasably securing the pocket access opening between open and closed positions and a loop holder attached thereon to hold necessary items for a user thereto according to the present invention.
Figure 11:
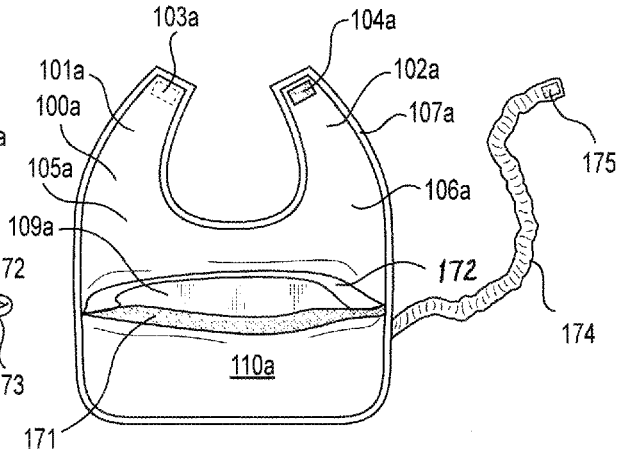
FIG. 11 illustrates a front view of the bib with mating attachment means along opposite interior surfaces of a bib pocket access opening at top edges thereof for releasably securing the pocket access opening between open and closed positions and a stretchable holder attached thereon to hold necessary items for a user thereto according to the present invention.

FIGS. 10 and 11 shows the same elements except that FIG. 10 depicts a hoop holder 173 for pacifiers, toys, trinkets or other necessary items and FIG. 11 depicts a strap or string like holder 174 for holding pacifiers, toys, trinkets or other necessary items thereto.

Figure 9:
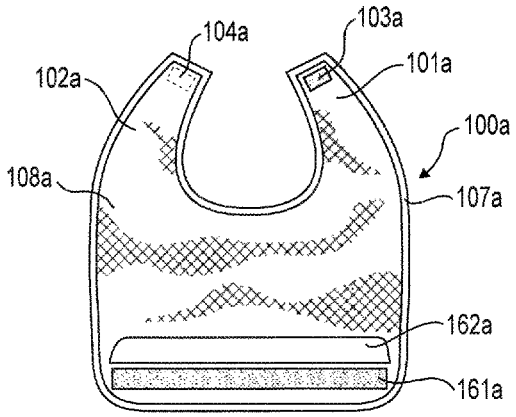
FIG. 9 illustrates a back or rear view of the bib with a safety flap for covering an attachment mechanism thereon that secures the bib to an apron that is detached according to the present invention.

FIG. 9 shows a back or rear view of the bib 100*a* with a back layer 108*a*, a border 107*a* extending about the bib 100*a* and a pair of arms 101*a* and 102*a* with hook and loop fasteners 103*a* and 104*a* disposed thereon for securing the bib 100*a* about the neck of a user. Note that the previous discussion of FIG. 2 is applied here as well. Also, FIG. 9 shows a safety flap cover member 162*a* that releasably covers the hook and loop fastener 161*a* that is positioned and extending along a bottom portion between and with each end being adjacent to the border 107*a* to prevent damage to thereto. Another main reason for the safety flap cover member 162*a* to is protect the hook and loop fastener 161*a* from touching the skin of a user, especially an infant or young child when the bib 100a is being used without the apron 130.

FIG. 10 illustrates a front view of the bib 100*a* with mating hook and loop attachment means 171, 172 disposed along opposite top and bottom edge surfaces of a bib pocket access opening 109*a* at top edges thereof for releasably securing the pocket access opening 109*a* between open and closed positions and a loop item holder 173 secured at a selected peripheral edge between the front layer 105*a* and the back layer 108*a* to hold pacifiers, toys, trinkets or other necessary items thereto.

FIG. 11 illustrates a front view of the bib 100*a* with mating hook and loop attachment means 171, 172 disposed along opposite top and bottom edge surfaces of a bib pocket access opening 109*a* at top edges thereof for releasably securing the pocket access opening 109*a* between open and closed positions and a stretchable strap or string item holder 174 with one end attached at a selected peripheral edge between the front layer 105*a* and the back layer 108*a* and the other end having a hook and loop attachment means 175 to hold pacifiers, toys, trinkets or other necessary items thereto.

It is being noted that the front layer 105, 105*a*, the border 107, 107*a*, and the back layer 108, 108*a* of the bib 100, 100*a* can be of the same material with the same designs and/or colors, so that it can be reversible, if desired. Also, the apron 13, 130*a*, 137, 137*a* can be of the same material with the same designs and/or colors, so that it can be reversible, if desired. The bib and apron can be selected from many different types of lightweight water resistant materials consisting of fabrics, polymers, plastic, rubber, nylon, neoprene, polyester and any combination of the different types of materials, to name just a few. Also, the safety flap cover members can be made from the same material with the same designs and/or colors as well as being selected from many different types of lightweight water resistant materials, such as fabrics, polymers, plastic, rubber, nylon, neoprene, polyester and any combination of the different types of materials, to complement the bib 100, 100*a* and the apron 130, 130*a*, 137, 137*a*.

Furthermore, the apron 130, 130*a*, 137, 137*a* can be utilized alone as an apron or smock in many different types of environments, such as a use for children, students, patients, cleaning personnel and many other professional types.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. The invention should therefore not be limited by the above described embodiments, and examples, but by all embodiments and methods within the scope and spirit of the invention as claimed.

What is claimed is:

1. A multi-functional bib and apron combination comprising:

a bib member having a front surface and a back surface;

an upper portion of the bib member front surface having a pair of arm portions forming a neck receiving opening, each arm portion having a fastener disposed at an upper end thereof and being oppositely positioned so that the fasteners are configured to releasably engage the arm portions about the neck of a user;

at least a pocket member extending along at least a portion of a length of the front surface between a pair of peripheral edges of the bib member, the pocket member having a height extending from a bottom edge of the bib member upward to a location that is spaced below the neck opening;

the back surface of the bib member having a first securing member extending along at least a portion of a length thereof, between the pair of peripheral edges of the bib member and disposed adjacent a bottom edge of the back surface of the bib member;

an apron member having a first upper elongated vertical and horizontal leg section areas defining a first smaller body area dimension extending from an upper end to an intermediate location of the apron member and a second elongated leg section defining a second body area dimension greater than the first smaller body area dimension due to a wider horizontal and vertical body wing areas extending from the intermediate location to a bottom end of the second elongated leg section with the first smaller body area dimension and the second greater body area dimension being perpendicular to one another as a result of the wider horizontal and vertical body wing areas, which forms an inverted T-shaped configuration;

a second securing member positioned at an upper end of the first upper elongated vertical and horizontal leg section areas and extending along at least a portion of a length thereof for releasably engaging the first and second securing members together so that the bib member and apron member are attached together as a single multi-functional unit and adapted to cover a user's body extending from the user's neck to the top of the user's feet; and a safety cover member is connected to a top portion of the first smaller body area dimension of the apron and extending along at least a portion of the length of the first smaller body area dimension of the apron and having a third securing member disposed on a back surface thereon, the safety cover member having a first flipped upstanding position that abuts and covers at least a portion of the front surface of the bib member and also the third securing member abuts and is shielded against the at least a portion of the front surface of the bib when the first and second securing members are directly engaged with one another so that the bib member and apron member are connected together and defining the single multi-functional unit, and a second flipped position that allows the safety cover member to be moved from the first upstanding flipped position to a pivoted securing position that allows the second securing member at the top portion of the first smaller body area dimension of the apron to engage the third securing member on the back surface of the safety cover member to always cover and protect the second and third securing members from damage when the bib member is releasably detached from the apron member.

2. The multi-functional bib and apron combination according to claim 1, wherein the bib has a border element from a selected group consisting of solid or multi-colors that is stitched around the entire outer peripheral edge of the bib, the arm portions and the neck opening to compliment the bib design.

3. The multi-functional bib and apron combination according to claim 1, wherein the first smaller dimension area of the apron member is adapted to extend and at least cover a user's stomach and knees and the second greater body area dimension of the apron member is adapted to extend and entirely cover from the knees to the ankles of the user.

4. The multi-functional bib and apron combination according to claim 1, wherein the apron has a first pair of securing straps attached to a location directly at opposite peripheral edges of the first smaller body area dimension at an upper end thereof and adapted to be tied together about a user's neck along with the pair of arm portions of the bib member being secured about the user's neck as well.

5. The multi-functional bib and apron combination according to claim 4, wherein the apron member has a second pair of securing straps attached to a location directly at opposite peripheral edges of the first smaller body area dimension and between the top end thereof and a top end of the second greater body area dimension and below the first pair of securing straps and adapted to be tied together about a user's waist when the bib member is secured about the user's neck as well.

6. The multi-functional bib and apron combination according to claim 1, wherein the arm portions of the bib member are oriented to form a U-shape neck opening.

7. The multi-functional bib and apron combination according to claim 5, wherein one of each of the first pair of securing straps and one of each of the second pair of securing straps are secured together to form arm loops on each side of the apron member and adapted to allow a user to place their arms through them to secure the apron member on the user when the bib is attached to the apron member and secured about the neck of the user.

8. The multi-functional bib and apron combination according to claim 1, wherein the bib member and apron have various types of designs or prints thereon that will be complementary to one another.

9. The multi-functional bib and apron combination according to claim 1, wherein the bib member and apron combination is configured to fully cover a user's clothing to prevent staining from messy eating or the wasting of food and drinks thereon or for hygienic purposes.

10. The multi-functional bib and apron combination according to claim 1, wherein the pocket member includes an access opening that allows articles, such as, toys, keys, medicine, snacks and other items to be inserted within the pocket member; and the pocket member includes fastening elements from the selected group consisting of buttons, zippers, snaps or hook and loop type fasteners to open and close the pocket access opening.

11. The multi-functional bib and apron combination according to claim 1, wherein the safety cover member is connected at the top portion of the first smaller body area dimension of the apron member and is defined as a foldable flap, the safety foldable flap cover member extends at least across a portion of the length of the top portion of the first smaller dimension area with the third securing means disposed thereon and having at least a hook and loop fastener at each peripheral end of the safety foldable flap cover member on a front surface of the first smaller body area dimension, wherein the safety foldable flap cover member is folded and flipped entirely over the second securing member and defining a hook and loop fastener positioned at the upper end of the first smaller body area dimension for releasably engaging the at least a hook and loop fastener at each peripheral end of the safety foldable flap cover member with the hook and loop fastener of the first smaller dimension area to cover and protect the hook and loop fastener of the first smaller body area dimension and the hook and loop fastener at each peripheral end of the safety foldable flap cover member from any damage when the bib is releasably detached from the apron member.

12. The multi-functional bib and apron combination according to claim 1, wherein the fasteners of the arm portions of the bib member and the securing members of the apron member may be from the selected group consisting of buttons, zippers, snaps or hook and loop type fasteners.

13. The multi-functional bib and apron combination according to claim 1, wherein the bib member and apron member may be made from the selected group of lightweight waterproof material consisting of fabrics, polymers, plastic, rubber, nylon, neoprene, polyester, or any combination of the different types of materials.

14. The multi-functional bib and apron combination according to claim 1, wherein the back side of the bib member is provided with a reinforcing layer between the front and back surfaces to add additional support and stiffness to the bib member.

15. A bib being releasably attached to an apron member comprising:

a bib member having a front surface and a back surface;

the bib member has a pair of arm portions forming a neck receiving opening, each arm portion having a fastener disposed at an upper end thereof and being oppositely positioned so that the fasteners will engage one another and adapted to be secured about the neck of a user;

at least a pocket member with an access opening therein that extends from each peripheral edge of the bib member and along at least a portion of a length of the front surface thereof;

a first securing member disposed on and along at least a portion of a length of the back surface of the bib member with ends being contiguous to each peripheral edge of the bib member and being positioned at a bottom end peripheral edge thereof and being removably attached to a second securing member disposed at a top end of an upper smaller dimensional section of an apron member and the second securing member extending along at least a portion of a length of the upper smaller dimensional section of the apron member with ends being contiguous to the peripheral edges of the top end of the upper smaller dimensional section of the apron member;

the upper smaller dimensional section of the apron is connected to a lower larger dimensional section of the apron;

a safety flap cover member is connected to the top of the upper smaller dimensional section of the apron and being flipped between an extended upward position and a foldable position; and a safety flap cover member having a fastening member disposed along the back surface of the bib member and disposed above the back surface securing member adjacent the bottom end peripheral edge, wherein the safety flap cover member of the bib is flipped downward and folded entirely over the first securing member of the bib member to releasably engage the fastening member of the safety flap cover member of the bib member to cover and protect the first securing member of the bib member from any damage whenever the bib is detached from the apron member and the safety flap cover member is flipped upward and is adapted to be secured to a front portion of the top of the smaller dimensional section of the apron member to shield and protect the entire safety flap cover member of the bib member from damage when the bib member is releasably attached to the apron member, thereby allowing the first securing member of the bib member to cooperatively engage with the second securing member disposed at the top end of the upper smaller dimensional section of the apron member after the safety flap cover member of the bib member has been flipped upward and against the back surface of the bib member to allow the bib member and apron to become secured together as a single unit.

16. The bib releasably attached to an apron member according to claim 15, wherein a loop holder is selectively secured along a peripheral edge of the bib member between the front and the back surfaces to hold pacifiers, toys, trinkets or other necessary items thereto.

17. The bib releasably attached to an apron member according to claim 15, wherein a stretchable item holder has one end that is selectively secured along a peripheral edge of the bib member between the front and the back surfaces thereof, with the other end having a securing member thereon to hold pacifiers, toys, trinkets or other necessary items thereto.

18. The bib releasably attached to an apron member according to claim 15, wherein the pocket access opening includes mating hook and loop type attachment elements disposed along opposite surfaces of the bib pocket access opening at top and bottom edges thereof for releasably securing the pocket access opening between open and closed positions.

19. An apron releasably attached to a bib member comprising:

an apron member having a first elongated body section having a first smaller dimensional area extending from an upper end to an intermediate location of the apron member and a second elongated wing body section having a second larger dimensional area that extends further outward and longer in length than the first smaller dimension area, the extended wing body section extends from the intermediate location to a bottom end thereof and being perpendicular to the first elongated body section at the intermediate location forming an inverted T-shaped configuration and adapted to cover a user's stomach, knees and extending downward to a user's ankles;

a first securing member positioned at an upper end of the first elongated body section along the entire length thereof for releasably engaging the first securing member with a second securing member of a bib member together so that the bib member and the apron member are attached together as a single multi-functional unit;

a separate strap element secured adjacent an upper corner portion of the apron member at each side peripheral corner edge thereof and adapted for selectively securing the strap elements about an user's neck and alternatively, connected together to form loops that are adapted to allow a user's arms to be extended there through;

a stretchable waist strap having one end secured to the peripheral edge near the intermediate location and the other end having an attachment member for removably engaging a mating attachment member on a back surface of the apron at a peripheral edge near the intermediate location and adjacent to a top end of the second extended wing body section; and a separate safety pocket device including a back pull-apart wall portion at a back side surface upper peripheral side corner edge at the top of the first smaller dimension area of the apron member and at an upper side peripheral corner edge at the top of the first smaller dimension area of the apron member front surface, the back pull-apart wall portion is located directly behind the apron front surface and the first securing member at the upper peripheral corner edges along a side peripheral edge seam portion of the first smaller upper elongated dimension area of the apron member, wherein the pull-apart wall portions define a selectively closable pocket opening there between that provides a storage space for storing the separate straps elements therein when the bib is to be attached thereto and the separate straps are not being used, each corner closable pocket opening has securing members disposed on interior walls of the front and back pull-apart wall portions to completely close each pocket opening along the side peripheral corner edge seam portion.

20. The apron releasably attached to a bib member according to claim 19, wherein the pocket opening securing member further includes a first fastening element that defines a hook and loop fastener disposed on an interior surface of the back pull-apart wall portion that releasably mates with a second fastening element that defines a hook and loop fastener disposed on an interior surface of the front pull-apart wall portion behind the first securing member within the pocket opening for opening and closing the pocket opening;

a safety flap cover member is attached to an upper portion of the first smaller dimensional area of the apron member and extending along an entire length thereof and having a third securing member disposed on a back surface thereon, the safety flap cover member having an upward flipped position that abuts and covers at least a portion of the back surface of the bib member at a bottom end thereof and also the third securing member abuts and is shielded against the at least a portion of the back surface of the bib member when the first and second securing members are directly engaged with one another so that the bib member and apron member are connected together and defining the single multi-functional unit, and a second position that allows the safety flap cover member of the apron to be moved from the upward flipped position to a securing position that allows the second securing member at the top portion of the first smaller dimension area of the apron to engage the third securing member on the back surface of the safety flap cover member of the apron to always cover and protect the second and third securing members from damage when the bib is releasably detached from the apron member, and a safety flap cover member is attached directly to a back surface at a bottom end of the bib member and is disposed above and is moved over the first securing member to selectively cover and protect the first securing member and adapted to cover and protect a user's body when the bib member is detached from the apron member.

* * * * *